United States Patent [19]

Sachs

[11] Patent Number: 4,973,259

[45] Date of Patent: Nov. 27, 1990

[54] GROUND CONNECTOR FOR SHIELDED CABLE

[76] Inventor: Isaac Sachs, 1240 Ridgewood Dr., Chomedey, Laval, Canada, H7W 1L3

[21] Appl. No.: 414,246

[22] Filed: Sep. 29, 1989

[51] Int. Cl.[5] ..... H01R 4/66

[52] U.S. Cl. ..... 439/98; 439/795; 248/61

[58] Field of Search ..... 439/98, 100, 795, 799, 439/800; 174/41, 78, 40 CC; 248/61, 74.3

[56] References Cited

U.S. PATENT DOCUMENTS

| | | | |
|---|---|---|---|
| 516,205 | 3/1894 | Johnson | 248/61 |
| 1,020,130 | 3/1912 | Davidson | 248/61 |
| 1,616,847 | 2/1927 | Feige | 439/795 |
| 1,809,009 | 6/1931 | Andre | 439/795 |
| 2,554,169 | 5/1951 | Bergan | 439/795 |
| 3,985,411 | 10/1976 | Mooney et al. | 439/100 |

FOREIGN PATENT DOCUMENTS

| | | | |
|---|---|---|---|
| 1016864 | 11/1952 | France | 248/61 |

*Primary Examiner*—Gary F. Paumen

*Attorney, Agent, or Firm*—Charles E. Brown; Charles A. Brown

[57] ABSTRACT

A ground connector for securing a grounding wire to a conductive shield of a coaxial cable. The connector comprises a strip of flexible sheet metal which is configured to be bent to form a grounding wire attachment loop and a coaxial cable loop. The strip of sheet metal defines clamp portions each having a fastener securing aperture. A fastener clampingly engages the clamp portions through the apertures to clampingly engage the grounding wire attachment loop and the coaxial cable loop about respectively to a grounding wire and a conductive shield of a coaxial cable. At least the coaxial cable loop has an inner serrated surface portion for frictional retention with an outer surface of the conductive shield when clamped substantially thereabout by the tightening of the fastener and prevents the shield from being punctured or damaged thereby.

12 Claims, 2 Drawing Sheets

GROUND CONNECTOR FOR SHIELDED CABLE

BACKGROUND OF INVENTION (a) Field of the Invention

The present invention relates to an improved ground connector for securing a grounding wire to a conductive shield of a coaxial cable and wherein at least the coaxial cable attachment loop is provided with at least an inner serrated surface portion for frictional retention with an outer surface of a conductive shield of a coaxial cable.

(b) Description of Prior Art

Grounding connectors for securing a ground wire to another cable are well known in the art. For example, such connectors are described and illustrated in U.S. Pat. Nos. 1,616,874; 1,809,009 and 2,554,169. It is pointed out that with these prior art connectors, there is often a point contact somewhere along the connector sleve to engage and prevent rotation of the sleeve. This is a problem with coaxial cables when a fragile conductive shield surface is required to be grounded. This point contact often results in damage to the shielding material, which is usually a fragile aluminum foil. The damaged shield then does not provide shielding of stray interference signal in that area and this affects the signal being transmitted, particularly at high frequencies. In other words, puncturing of the shield results in the introduction of noise onto the transmitted signal. Also, with the prior art connectors, often too much clamping pressure is applied to get a good grip on the cable and this also damages the shield and the insulation.

It is therefore important to obtain good frictional contact with the fragile metal shield of the coaxial cable so as to provide proper grounding contact. At the same time, it is important not to apply too much clamping pressure to the fragile metal foil shield of the coxial cable to cause damage thereto.

SUMMARY OF INVENTION

It is a feature of the present invention to provide an improved ground connector for securing a ground wire to a conductive shield of a coaxial cable and wherein the connector is provided, at least in an inner surface of the coaxial cable loop thereof, with a serrated surface portion for frictional retention with an outer surface of the conductive shield.

Another feature of the present invention is to provide an improved one-piece ground connector having a novel configuration and which substantially overcomes all of the above-mentioned disadvantages of the prior art.

It is a further feature of the present invention to provide a single-piece ground connector which is formed from an elongated flat strip of flexible sheet metal and which may be assembled on site and further wherein positive retention is provided with a coaxial cable shield without deformation or causing puncture of the shield and with very little clamping pressure being necessary.

Another feature of the present invention is to provide a one-piece ground connector strip and fastener means which is easily assemble in a figure-8 configuration to form a ground connector having a grounding wire attachment loop and a coaxial cable loop, with both said loops having a serrated surface portion for frictional retention with a ground cable and the metal shielding foil on a coaxial cable, respectively.

According to the above features, from a broad aspect, the present invention provides a ground connector for securing a grounding wire to a conductive shield of a shielded cable. The connector comprises an elongated strip of flexible sheet metal having an enlarged end portion and an elongated belt section and an aperture in the enlarged portion having a width sufficient to accommodate the passage of said belt section therethrough. The strip is bent in a figure-8 configuration to form a grounding wire compression attachment loop and a compression shielded cable loop. The strip defines clamp portions at opposed ends thereof. Each clamp portion has a fastener securing means. A fastener is provided for clampingly engaging the clamp portions through the securing means to clampingly engage the grounding wire attachment loop and the shielded cable loop about a respective grounding wire and a conductive shield of a cable. The shielded cable loop and the attachment loop have an inner surface portion which is in compression retention with an outer surface of the conductive shield and the shielded cable respectively, when clamped thereabout simultaneously by the tightening of the fastener. The shielded cable loop and the attachment loop prevent damage to the shield by being spaced from one another.

According to a further broad aspect of the present invention, the wire attachment loop is also provided with an inner serrated surface for frictional retention about the grounding wire.

According to a still further broad aspect of the present invention, there is provided a grounding connector for securing a grounding wire to a conductive shield of a coaxial cable. The ground connector is formed by an elongated strip of flexible sheet metal having an enlarged end section and an elongated rectangular belt section. Fastener securing means is provided at opposed ends of the elongated strip. An aperture is provided in the enlarged section and has a width greater than the width of the belt section. At least one serrated surface section is formed by a plurality of adjoining ridges of saw-tooth cross-section disposed on opposed surfaces of the strip and extending across the width thereof. One serrated surface section extends in an intermediate region between the enlarged end section and elongated rectangular belt section and into an end section of the aperture. A serrated surface section is also disposed on the other opposed surface of the strip and aligned adjacent opposed ends of the one serrated surface section.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
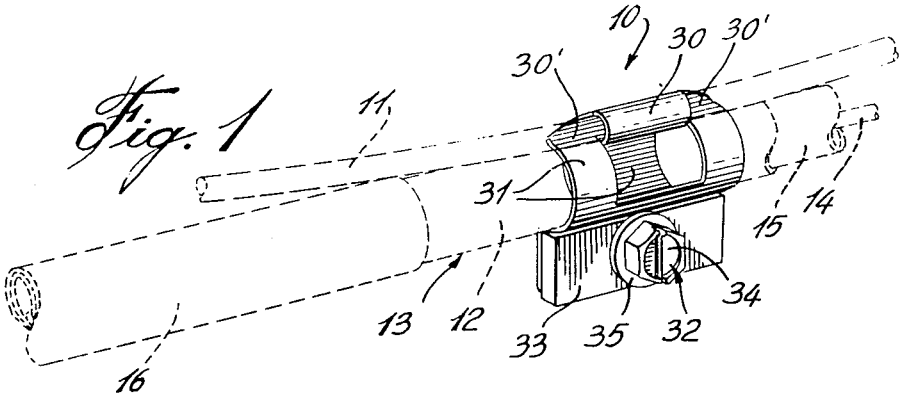
FIG. 1 is a perspective view of the ground connector of the present invention.
Figure 2:
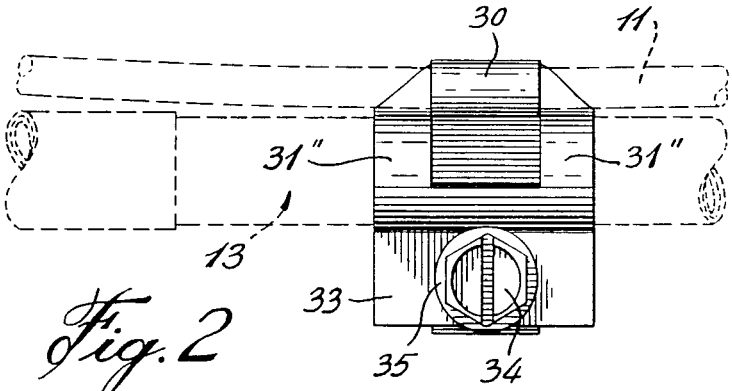
FIG. 2 is a side view of the ground connector of FIG. 1.
Figure 3:
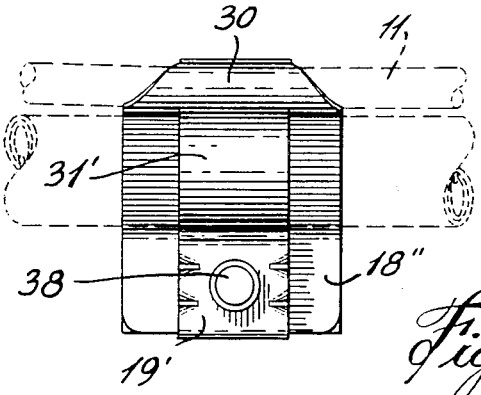
FIG. 3 is an opposed side view of the ground connector of FIG. 1.
Figure 4:
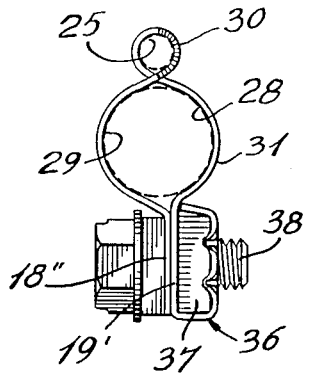
FIG. 4 is an end view of the ground connector of FIG. 1.

Referring now to the drawings, and more particularly to FIG. 1, there is shown generally at 10, the ground connector of the present invention which is utilized for securing a ground wire 11 to a conductive shield 12 of a coaxial cable 13. As herein shown, the coaxial cable has a conductive wire 14 encapsulated in an insulating core 15 which is covered by the shield 12 which is usually a fragile aluminum sheet. An insulating cover 16, usually of rubber or plastics material, is disposed and protects the shield 12.

Figure 5:
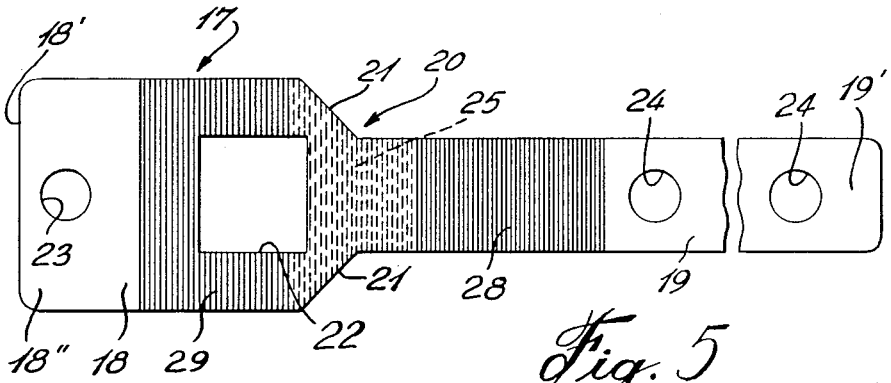
FIG. 5 is a plan view showing the construction of the ground connector strip made of flexible sheet metal.

Referring now additionally to FIGS. 2 to 5, and particularly to FIG. 5, it can be seen that the ground connector 10 of the present invention is formed by a strip of flexible sheet metal 17 which is configured to form an enlarged substantially rectangular end section 18 and an elongated rectangular belt section 19 formed integral therewith and merging at an intermediate region 20 through angulated edges 21 extending from the opposed side edges of the enlarged end section 18 to the parallel side edges of the belt section 19. A substantially rectangular aperture 22, herein a square aperture, is provided in the enlarged section 18 close to the intermediate region 20 and has a width which is greater than the width of the belt section 19 so that the belt section may be passed through the aperture 22, as will be described later.

Fastener securing means in the form of holes are disposed adjacent the free ends of the elongated rectangular belt section 19 and the enlarged end section 18. As herein shown, a single hole 23 is disposed mid-width adjacent the end wall 18' of the enlarged end section 18 and at least two holes 24 are spaced apart along a free end portion of the elongated rectangular belt section 19. A plurality of these holes may be formed in the free end section of the belt section 19 to provide adjustability for the clamping loops, as will also be described later.

Figure 6:
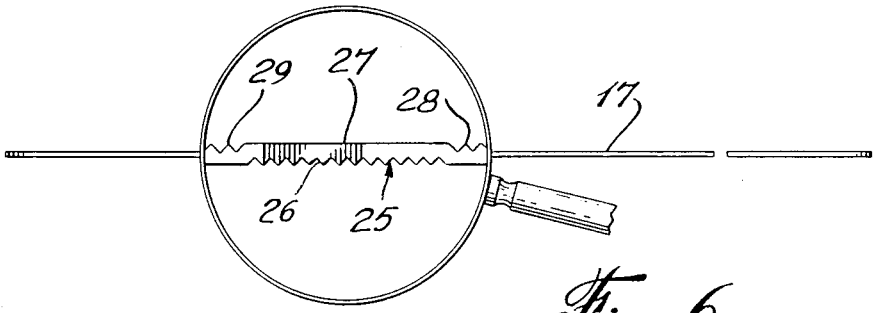
FIG. 6 is an enlarged cross-section view showing the configuration of the serrated surface portions of the strip shown in FIG. 5.

As also seen in FIG. 5, the intermediate region 20 of the strip 17 is provided with a serrated surface portion 25 which is formed by a plurality of adjoining ridges 26 (see FIG. 6), which ridges are of saw-tooth cross-section and extend widthwise of the strip 17. On the opposed surface 27 of the strip, there is provided a serrated surface section 28 and 29 on each side of the intermediate serrated surface. The serrated surfaces 25, 28 and 29 form frictional retention surfaces on the inner face of a grounding wire attachment loop 30 and inner surfaces of a coaxial cable loop 31, as shown in FIG. 1.

Referring again more particularly to FIGS. 1 to 4, it can be seen that when the elongated rectangular belt section 19 of the strip is passed through the aperture 22 from the side surface 27 of the strip, that a figure-8 ground connector is formed, as better seen in FIG. 4. Thus, there is defined the grounding wire attachment loop 30 and the coaxial cable loop 31. Such ground connector can be formed in the field when an existing grounding wire passes alongside a coaxial cable or else the ground connector can be preformed, particularly for use when a ground connector end is to be attached to the attachment loop 30.

After the strip of flexible sheet metal 17 is bent in its figure-8 configuration to form the ground connector, it can be seen that the ground wire attachment loop 30 defines a substantially cylindrical sleeve. The coxail cable loop 31 defines a substantially semicircular large flange wall 31' (see FIG. 3) and a pair of smaller flange walls 31'' (see FIG. 2) on an opposite side of the large flange wall 31' and one on opposed sides thereof. The wide coaxial cable loop 31 also has the serrated surfaces 28 and 29 disposed inwardly thereof and provides excellent frictional retention when the coaxial cable loop is slightly compressed on the outer surface of the conductive shield 12 to prevent the shield from being punctured as it requires very little compression to obtain good frictional contact. Accordingly, with little clamping pressure, the coaxial cable loop 31 is positively secured about the shield and cannot be rotated thereabout.

In order to secure the ground connector 10 to the grounding wire 11 and the coaxial cable 13, there is provided a clamp formed with the end portion of the strip 17. These portions cooperate with a bolt fastener 32 and a clamping bar 33. The free end portion 18'' of the enlarged end section 18 is a flat portion and on which is received the flat rectangular clamping bar 33 which is also provided with a through bore (not shown). This clamping bar is held against the end portion 18'' by the head 34 of the bolt and a washer 35. The other end portion 19' of the elongated rectangular belt section 19 is bent to form a U-shaped bend 36 therein whereby it extends over opposed surfaces of the nut 37 with the hole 24 aligned with the threaded bore (not shown) of the nut 37. By threading the threaded shaft 38 of the bolt through the nut 37, the end portions 18'' and 19' come closer together thus applying clamping pressure to the ground wire attachment loop 30 and the coaxial cable loop 31.

It is pointed out that the end wall portion 18'' of the enlarged end section 18 may also have a further elongation, provide with an additional hole 23 whereby to provide adjustability to the size or diameter of the coaxial cable loop 31, as is obvious to a person skilled in the art. This adjustability could also be provided by having more holes provided in the end section 19' of the belt section 19, as previously described.

As can be seen in FIG. 1, the serrated surface portion 25 of the ground wire attachment loop extends into an end region of the aperture 22 so that gripping ridges extend under the cylindrical portion 30 as well as in the interconnecting region 30' whereby to better grip the grounding wire with only slight compression force applied thereto. It is further pointed out that the serrated surface portions 25, 28 and 29 may be disposed in spaced apart serrated portions and not necessarily require that the entire area be serrated, so long as there is sufficient surface area for good frictional retention. Still further, the apertures 28 and/or 24 may be of a selected diameter to also engage with the threads provided on the threaded shaft of the bolt.

It is within the ambit of the present invention to cover any other obvious modifications of the embodiment described herein, provided such modifications fall within the scope of the appended claims. It is also pointed out that the ground connector of the present invention can also be used for clamping grounding wires to pipes having rigid surfaces, such as copper galvanized pipes. The provision of the serrated retention surfaces also provide excellent frictional retention with solid surfaces by using minimal gripping force to prevent deformation or puncturing of such surfaces.

I claim:

1. A ground connector for securing a grounding wire to a conductive shield of a shielded cable, said connector comprising an elongated strip of flexible sheet metal having an enlarged end portion and an elongated belt section and an aperture in said enlarged portion having a width sufficient to accommodate the passage of said belt section therethrough, said strip being bent in a figure-8 configuration to form a grounding wire compression attachment loop and a compression shielded cable loop, said strip defining clamp portions at opposed ends thereof, each clamp portion having a fastener securing means, a fastener for clampingly engaging said clamp portions through said securing means to clampingly engage said grounding wire attachment loop and said shielded cable loop about a respective grounding wire and a conductive shield of a cable, said shielded cable loop and said attachment loop having an inner surface portion which is in compression retention with an outer surface of said conductive shield and said grounding wire, respectively, when clamped thereabout simultaneously by the tightening of said fastener, said shielded cable loop and said attachment loop being disposed side-by-side and each being clamped independently at the same time to prevent damage to said shield by being spaced from one another.

2. A ground connector as claimed in claim 1 wherein said shielded cable loop is a coaxial cable loop provided with an inner serrated surface for frictional retention about said grounding wire.

3. A ground connector as claimed in claim 2 wherein said wire attachment loop is also provided with an inner serrated surface, said serrated surfaces are each provided by a plurality of adjoining ridges of saw-tooth cross-section extending over said inner surfaces and extending axially in at least a portion of said elongated strip containing said aperture.

4. A ground connector as claimed in claim 3 wherein said serrated surface of said coaxial cable loop is constituted by two spaced apart regions of a common face of said strip having said ridges formed thereon and extending transversely across said strip, said wire attachment loop having its said serrated surface formed on an opposed side of said strip between said two spaced apart regions.

5. A ground connector as claimed in claim 1 wherein said fastener securing means comprises at least one fastener receiving hole formed in opposite end portions of said strip.

6. A ground connector as claimed in claim 5 wherein one of said end portions is provided with at least two of said fastener receiving holes, said at least two holes being aligned with one another and providing an adjustment means to accomodate variation in the diameter of one or both said grounding wire and coaxial cable.

7. A ground connector as claimed in claim 6 wherein said fastener is a bolt fastener, said one of said end portions being bent about two opposed surfaces of a nut of said bolt fastener with two of said holes aligned with a threaded bore of said nut on a respective side of said nut.

8. A ground connector as claimed in claim 7 wherein a clamping bar is provided between a head of said bolt and the other of said end portions.

9. A ground connector as claimed in claim 1 wherein said belt section is an elongated rectangular strip portion, said aperture also being rectangular and having a width slightly larger than the width of said belt section.

10. A ground connector as claimed in claim 9 wherein said enlarged end portion is a substantially rectangular portion merging into said elongated rectangular strip in an intermediate region through opposed angulated edges, said aperture being located at an end portion of said enlarged end portion adjacent said angulated edges.

11. A ground connector as claimed in claim 10 wherein said serrated surfaces are each provided by a plurality of adjoining ridges of saw-tooth cross-section formed on opposed surfaces of said strip and extending across the width thereof, said grounding wire attachment loop being constituted by a strip section extending in said intermediate region from an end section of said aperture to an end section of said elongated rectangular strip, said coaxial cable loop being constituted by two strip sections disposed on opposed sides of said strip section of said attachment loop, one of said two strip sections extending a predetermined distance beyond said aparture and the other of said two sections extending a predetermined distance along said elongated rectangular strip, said serrated surfaces of said grounding wire attachment loop and coaxial cable loop being disposed on a respective side surface of said strip of flexible sheet metal.

12. A ground connector as claimed in claim 11 wherein said strip is bent by passing said elongated rectangular strip through said aperture from said side surface having said serrated surface sections of said coaxial cable loop to form said figure-8 configuration with said strip section of said attachment loop being smaller and formed integral with a larger coaxial cable loop formed by said two strip sections, said fastener securing means being comprised by a fastener receiving hole formed at an end portion of said enlarged end portion of said strip and at least two spaced apart fastener receiving holes formed at an end portion of said elongated rectangular strip, said fastener being a bolt fastener; said bolt having a head, a threaded shaft and a nut; said end portion of said strip being bent about two opposed surfaces of said nut with said two holes aligned with a threaded bore of said nut on a respective side of said nut, and a flat clamping bar having a bore therein disposed between said bolt head and said end portion of said enlarged end portion of said strip to distribute said clamping pressure across said end portion when said bolt is tightened.

* * * * *